US007808343B1

(12) United States Patent
Iannotti et al.

(10) Patent No.: US 7,808,343 B1
(45) Date of Patent: Oct. 5, 2010

(54) RADIO FREQUENCY (RF) SIGNAL COMBINER HAVING INVERTED COUPLER

(75) Inventors: Joseph Alfred Iannotti, Glenville, NY (US); William J. Taft, Yardville, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 155 days.

(21) Appl. No.: 12/245,474

(22) Filed: Oct. 3, 2008

(51) Int. Cl.
*H01P 5/12* (2006.01)
*H01P 3/08* (2006.01)

(52) U.S. Cl. ..... 333/117; 333/128

(58) Field of Classification Search ..... 333/117, 333/118, 122, 124, 125, 126, 128
See application file for complete search history.

(56) References Cited

U.S. PATENT DOCUMENTS 7,193,487 B2 * 3/2007 Alexander et al. ..... 333/104
7,319,370 B2 * 1/2008 Napijalo ..... 333/117
2009/0029550 A1 * 1/2009 Matsumoto ..... 438/691

* cited by examiner

*Primary Examiner*—Dean O Takaoka
(74) *Attorney, Agent, or Firm*—McDermott Will & Emery LLP

(57) ABSTRACT

A radio frequency (RF) communication device may include an RF 90-degree hybrid combiner having stable phase and loss characteristics over greater than one octave of bandwidth, while providing a high degree of isolation between input and isolated port. The structure may include a first element and a second element. The first element includes a first port, a first section for phasing matching, a second section for conductive-layer inversion, a third section for phase-matching section, and a third port. The second element includes a fourth port, a fourth section for phasing matching, a fifth section for conductive-layer inversion, a sixth section for phase-matching, and a second port. In one example, the second and fifth sections are utilized for signal coupling. In another example, the first, third, fourth, and sixth sections are utilized for signal coupling. Different ports may have matched phase differences.

20 Claims, 8 Drawing Sheets

RADIO FREQUENCY (RF) SIGNAL COMBINER HAVING INVERTED COUPLER

BACKGROUND

1. Field

The subject technology relates generally to communication devices, and more specifically to methods and apparatus for a radio frequency (RF) signal combiner having an inverted coupler.

2. Background

Conventional beam forming networks typically use costly active microwave monolithic integrated circuits (MMICs) for beam steering. Other all passive beam steering networks employ passive structures like couplers, combiners, phase shifter and the like but traditionally support a narrow band of operation (less than 1 octave). This is often due to the fact that couplers for radio frequency (RF) signals used in beam forming networks have produced poor phase matching and amplitude matching. Furthermore, conventional couplers for wide bandwidth applications require custom tuning and cannot effectively produce controlled coupling. A beam forming network may require multiple couplers in series, and in those instances, the shortcomings of conventional couplers have accumulative effects, producing very large amplitude and phase variations not tolerable by the network.

SUMMARY

In one aspect of the disclosure, an overlay coupler of a radio frequency (RF) signal combiner is a fundamental building block in complex RF structures and modules, specifically, in areas such as broadband Butler matrix designs. As multiple couplers are cascaded together in a variety of ways to construct these more complex structures, the variation associated with a conventional coupler limits the useful bandwidth of a Butler matrix and/or similar RF structures and modules. By implementing an inverted overlay coupler design, one can drastically reduce the frequency dependant variations that are normally associated with a traditional coupler, thus enabling wider instantaneous bandwidth RF structures and modules to be created.

In another aspect of the disclosure, a radio frequency (RF) communication device comprises an RF signal combiner. The RF signal combiner comprises a first element, a second element, and one or more dielectric layers. The first element comprises a first section for phase matching, a second section for conductive-layer inversion and signal coupling, and a third section for phase matching. The first section is connected to the second section. The second section is connected to the third section. Each of the first section, the second section, and the third section includes a conductive trace. The second element comprises a fourth section for phase matching, a fifth section for conductive-layer inversion and signal coupling, and a sixth section for phase matching. The fourth section is connected to the fifth section. The fifth section is connected to the sixth section. Each of the fourth section, the fifth section, and the sixth section includes a conductive trace.

The conductive trace of the second section is formed on a layer different from a layer on which the conductive trace of the first section is formed and different from a layer on which the conductive trace of the third section is formed. The conductive trace of the fifth section is formed on a layer different from a layer on which the conductive trace of the fourth section is formed and different from a layer on which the conductive trace of the sixth section is formed. The layer on which the conductive trace of the second section is formed is different from the layer on which the conductive trace of the fifth section is formed. The conductive trace of the second section is located in proximity to the conductive trace of the fifth section to allow signal coupling between the conductive trace of the second section and the conductive trace of the fifth section. The conductive trace of the second section is not in direct contact with the conductive trace of the fifth section.

In a further aspect of the disclosure, a radio frequency (RF) communication device comprises an RF signal combiner. The RF signal combiner comprises a first element, a second element, and one or more dielectric layers. The first element comprises a first section for signal coupling and phase matching, a second section for conductive-layer inversion, and a third section for signal coupling and phase matching. The first section is connected to the second section. The second section is connected to the third section. Each of the first section and the third section includes a conductive trace. The second element comprises a fourth section for signal coupling and phase matching, a fifth section for conductive-layer inversion, and a sixth section for signal coupling and phase matching. The fourth section is connected to the fifth section. The fifth section is connected to the sixth section. Each of the fourth section and the sixth section includes a conductive trace.

The second section comprises multiple conductive traces on multiple conductive layers. A first one of the multiple conductive traces of the second section is connected to a second one of the multiple conductive traces of the second section. The conductive trace of the first section is on a layer same as a first one of the multiple conductive layers of the second section, and the conductive trace of the third section is on a layer same as a second one of the multiple conductive layers of the second section. The fifth section comprises multiple conductive traces on multiple conductive layers.

A first one of the multiple conductive traces of the fifth section is connected to a second one of the multiple conductive traces of the fifth section. The conductive trace of the fourth section is on a layer same as a first one of the multiple conductive layers of the fifth section, and the conductive trace of the sixth section is on a layer same as a second one of the multiple conductive layers of the fifth section. The first section is located in proximity to the fourth section to allow signal coupling between the first and fourth sections, and the first section is not in direct contact with the fourth section. The third section is located in proximity to the sixth section to allow signal coupling between the third and sixth sections, and the third section is not in direct contact with the sixth section.

In yet a further aspect of the disclosure, a radio frequency (RF) communication device comprises an RF signal combiner comprising a plurality of conductive layers and one or more dielectric layers. The RF signal combiner comprises a first port, a second port, a third port, and a fourth port. The RF signal combiner comprises phase-matching sections for phase-matching, signal coupling sections for signal coupling, and conductive-layer inversion sections for conductive-layer inversion. The RF signal combiner comprises a first element and a second element.

The first element comprises the first port, the third port, a first one of the phase-matching sections, a first one of the signal coupling sections, and a first one of the conductive-layer inversion sections. The second element comprises the fourth port, the second port, a second one of the phase-matching sections, a second one of the signal coupling sections, and a second one of the conductive-layer inversion sections.

The first element comprises two conductive layers, and the first one of the conductive-layer inversion sections inverts a path of the first element from a first one of the two conductive layers to a second one of the two conductive layers of the first element. The second element comprises the two conductive layers, and the second one of the conductive-layer inversion sections inverts a path of the second element from the second one of the two conductive layers to the first one of the two conductive layers. The phase-matching sections are configured to match a phase difference between the first port and the third port with a phase difference between the fourth port and the second port. The phase-matching sections are configured to match a phase difference between the first port and the fourth port with a phase difference between the third port and the second port. The first element is not in direct contact with the second element. The plurality of conductive layers comprises the two conductive layers and a third conductive layer. The third conductive layer is a ground layer disposed below the two conductive layers.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

Figure 1A:
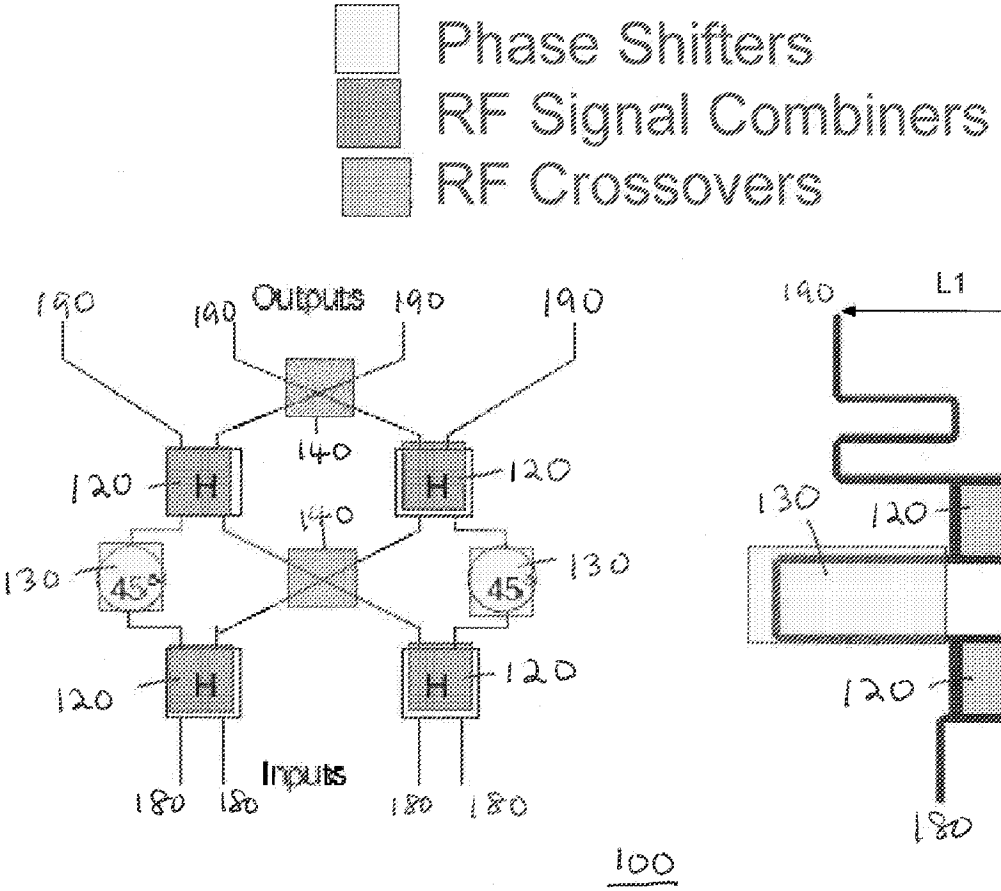
FIG. 1A is a conceptual block diagram illustrating an example of a Butler matrix.

FIG. 1A is a conceptual block diagram illustrating an example of a Butler matrix. In this example, a Butler matrix 100 is a 4×4 Butler matrix, but the subject technology is not limited to a 4×4 matrix and can be applied to any size matrix as well as to other communication devices. A Butler matrix 100 may be part of a passive microwave network or a beam forming network. It may include four inputs 180, four outputs 190, four radio frequency (RF) signal combiners 120 (e.g., hybrid combiners), two phase shifters 130 (e.g., 45-degree phase shifters), and two RF crossovers 140.

Each of the four inputs 180 may be used as an input and/or an output and may be connected to a receiver and/or a transmitter (e.g., a transceiver). Each of the four outputs 190 may be used as an input and/or an output and may be connected to an antenna to receive and/or transmit a signal. An RF signal combiner 120 may be used to combine RF signals, and a phase shifter 130 may be used to shift the phase of a signal. An RF crossover 140 may be used to send an RF signal over another RF signal. As shown in FIG. 1A, the paths of these signals cross over each other.

Figure 1B:
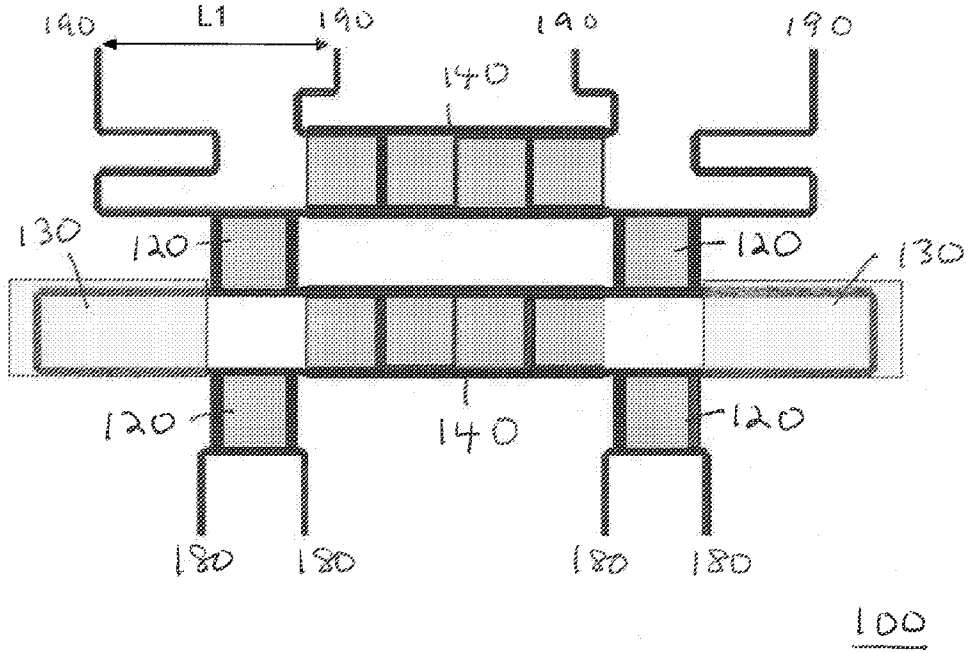
FIG. 1B is a conceptual diagram illustrating an example of a layout of the Butler matrix of FIG. 1A.

A conceptual diagram illustrating an example of a layout of the Butler matrix of FIG. 1A is illustrated in FIG. 1B. Like components are labeled with identical element numbers. The distance L1 may be, for example, about 60.3 mm.

Figure 1C:
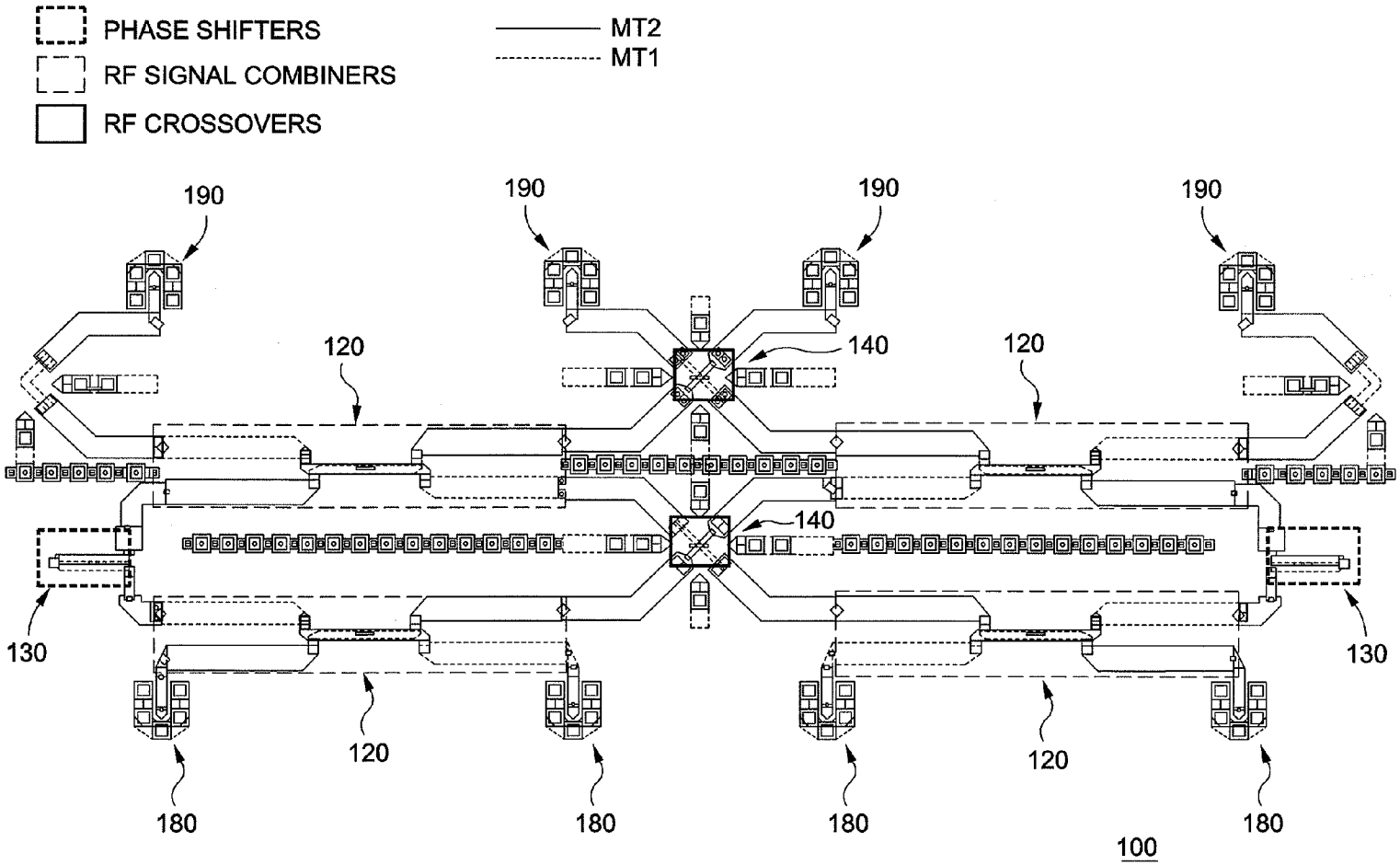
FIG. 1C is a conceptual diagram illustrating an example of a layout of the Butler matrix of FIG. 1A.

FIG. 1C is a diagram illustrating a top-down view of an example of a layout of the Butler matrix of FIG. 1A. The components (e.g., 120, 130, 140, 180 and 190) may be fabricated utilizing multiple conductive layers (e.g., metal layers) and dielectric layers between the conductive layers. Two metal layers—a metal layer 1 (MT1) and a metal layer 2 (MT2)—are shown in this example. The two metal layers and the dielectric layers may be placed above a third metal layer (e.g., a ground layer).

Figure 2A:
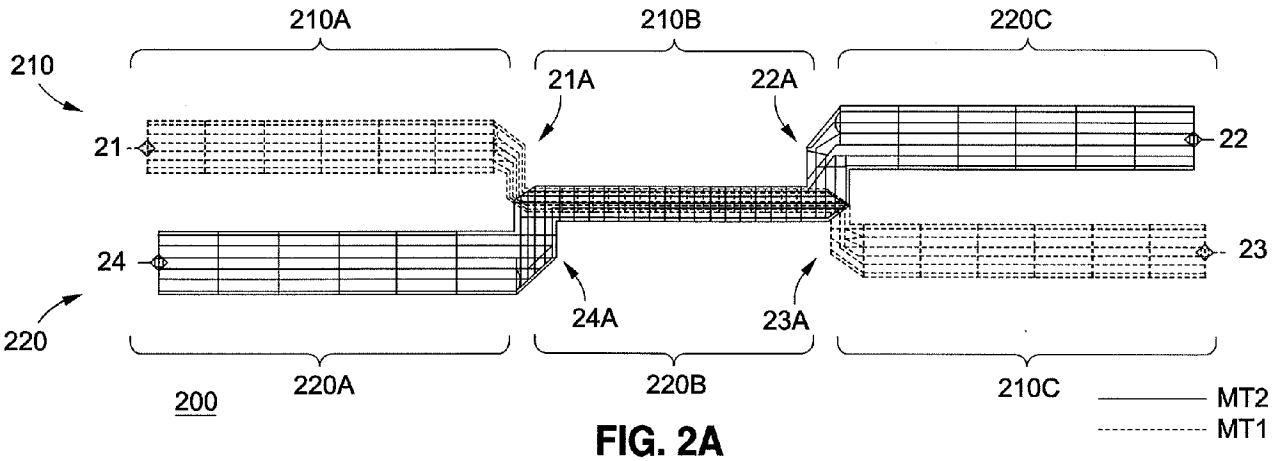
FIG. 2A is a diagrammatic top-down view depicting an example of a radio frequency (RF) signal combiner.

FIG. 2A is a diagrammatic top-down view depicting an example of a radio frequency (RF) signal combiner. An RF signal combiner 200 includes a first element 210 and a second element 220. Each of the first element 210 and the second element 220 may include a phase matching section and a signal coupling section.

The first element 210 includes a first port 21, a first section 210A for phase matching, a second section 210B for signal coupling, a third section 210C for phase matching, and a third port 23. The first and third sections 210A and 210C can act as a phase matching section, and the second section 210B can act as a signal coupling section. The second element 220 includes a fourth port 24, a fourth section 220A for phase matching, a fifth section 220B for signal coupling, a sixth section 220C for phase matching, and a second port 22. The fourth and sixth sections 220A and 220C can act as a phase matching section, and the fifth section 220B can act as a signal coupling section.

Figure 2B:
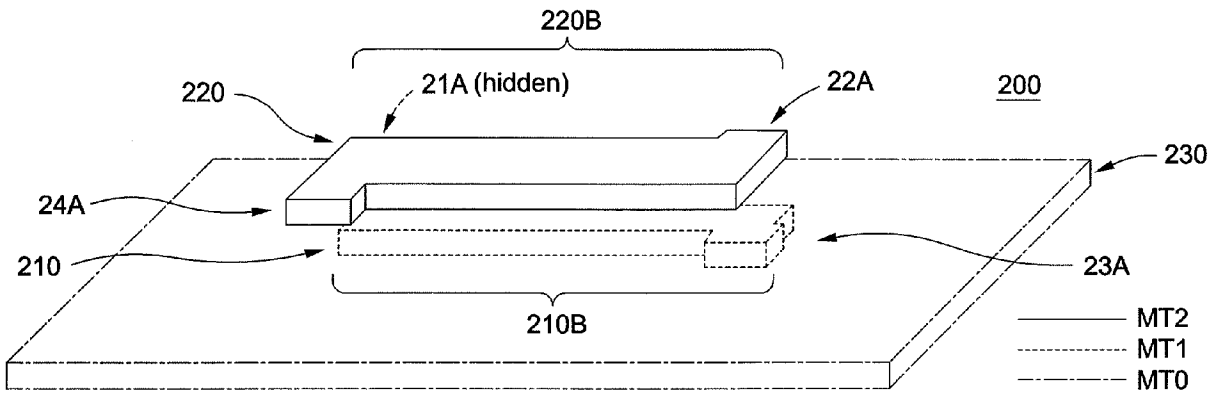
FIG. 2B is a diagrammatic perspective view depicting an example of a section of the RF signal combiner shown in FIG. 2A.

FIG. 2B is a diagrammatic perspective view depicting an example of a section of the RF signal combiner shown in FIG. 2A. Referring to FIGS. 2A and 2B, the first element 210 is on one conductive layer (e.g., a first metal layer, MT1), and the second element 220 is on another conductive layer (e.g., a second metal layer, MT2). A third conductive layer 230 (e.g., a third metal layer, MT0) may be placed below the two conductive layers. The third conductive layer 230 may be a ground layer. Dielectric layers may be placed between the conductive layers.

Each of the first section 210A, the second section 210B, and the third section 210C of the first element 210 is on the first metal layer, MT1. Each of the fourth section 220A, the fifth section 220B, and the sixth section 220C of the second element 220 is on the second metal layer, MT2. Each of the first element 210 and the second element 220 utilizes only one conductive layer throughout its entire conductive path without inverting the conductive layers (i.e., the first element 210 utilizes only MT1, and the second element 220 utilizes only MT2). A point 21A on MT1 indicates a junction between the first section 210A and the second section 210B. A point 23A on MT1 indicates a junction between the second section 210B and the third section 210C. A point 24A on MT2 indicates a junction between the fourth section 220A and the fifth section 220B. A point 22A on MT2 indicates a junction between the fifth section 220B and the sixth section 220C.

In this example, the signal coupling sections overlap vertically. For instance, the second section 210B (on MT1) overlaps the fifth section 220B (on MT2) vertically so that the signals traveling in sections 210B and 220B are coupled. The phase-matching sections, on the other hand, do not overlap in this example. For instance, the first section 210A (on MT1) do not overlap the fourth section 220A (on MT2), and the third section 210C (on MT1) do not overlap the sixth section 220C (on MT2).

Figure 3A:
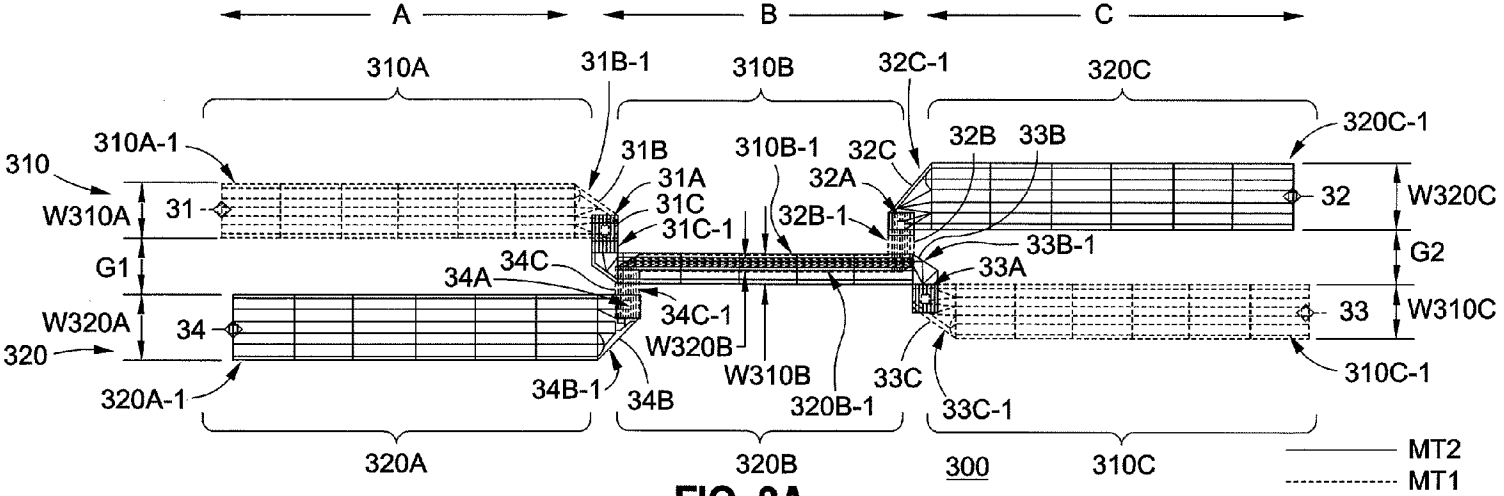
FIG. 3A is a diagrammatic top-down view depicting another example of an RF signal combiner.
Figure 3B:
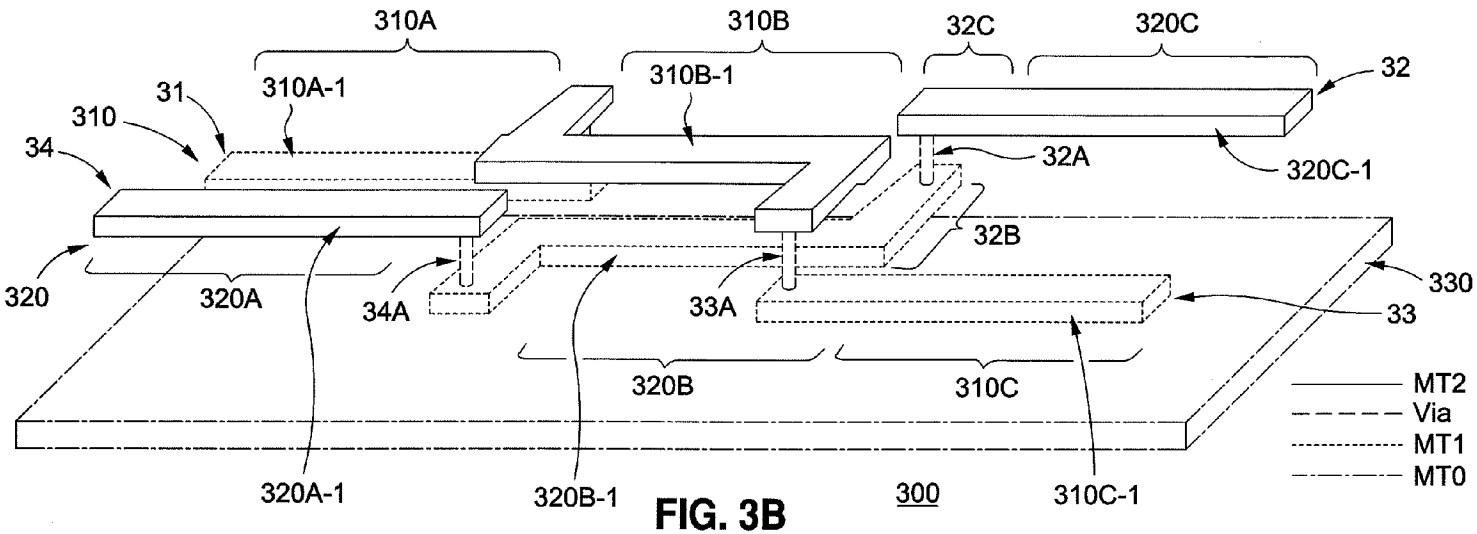
FIG. 3B is a diagrammatic perspective view depicting an example of the RF signal combiner shown in FIG. 3A.

FIG. 3A is a diagrammatic top-down view depicting an example of a radio frequency (RF) signal combiner. FIG. 3B is a diagrammatic perspective view depicting an example of a section of the RF signal combiner shown in FIG. 3A. Referring to FIGS. 3A and 3B, an RF signal combiner 300 includes a first element 310 and a second element 320. Each of the first element 310 and the second element 320 may include a phase matching section, a conductive-layer inversion section, and a signal coupling section. One or more sections may overlap or provide multiple functionalities. In this embodiment, one section acts as a conductive-layer inversion section as well as a signal coupling section.

The first element 310 includes a first port 31, a first section 310A for phase matching, a second section 310B for conductive-layer inversion as well as signal coupling, a third section 310C for phase matching, and a third port 33. Each of the first and third sections 310A and 310C can act as a phase matching section, and the second section 310B can act as a conductive-layer inversion section as well as a signal coupling section. The first element 310 may further include intermediary sections 31B, 31C, 33B, and 33C.

The second element 320 includes a fourth port 34, a fourth section 320A for phase matching, a fifth section 320B for conductive-layer inversion as well as signal coupling, a sixth section 320C for phase matching, and a second port 32. Each of the fourth and sixth sections 320A and 320C can act as a phase matching section, and the fifth section 320B can act as a conductive-layer inversion section as well as a signal coupling section. The second element 320 may further include intermediary sections 34B, 34C, 32B, and 32C.

The first section 310A and the fourth section 320A are in a first region A of the RF signal combiner 300, the second section 310B and the fifth section 320B are in a second region B of the RF signal combiner 300, and the third section 310C and the sixth section 320C are in a third region C of the RF signal combiner 300.

An RF signal combiner 300 may allow a signal from the first port 31 (an input port) to pass through the third port 33 (a through port) and may substantially isolate a signal from the input port 31 and the fourth port 34 (a coupled port) from passing through the second port 32 (an isolated port). The RF signal combiner 300 may allow a signal from the input port 31 to be coupled to the coupled port 34.

Referring to FIGS. 3A and 3B, the first element 310 includes a first conductive layer (e.g., a first metal layer, MT1), a second conductive layer (e.g., a second metal layer, MT2), a third conductive layer 330 (e.g., a third metal layer, MT0), a first dielectric layer (e.g., a layer 640 in FIG. 6) between the first conductive layer (e.g., MT1) and third conductive layer (e.g., MT0), and a second dielectric layer (e.g., a layer 650 in FIG. 6) between the second conductive layer (e.g., MT2) and the first conductive layer (e.g., MT1).

As for the first element 310, the first section 310A is on the first conductive layer (e.g., MT1), the second section 310B is on the second conductive layer (e.g., MT2), and the third section 310C is on the first conductive layer (e.g., MT1). The first section 310A is connected to the second section 310B using an intermediary section 31B (e.g., on MT1), a via 31A (e.g., a metal post connecting MT1 to MT2), and an intermediary section 31C (e.g., on MT2). The second section 310B is connected to the third section 310C using an intermediary section 33B (e.g., on MT2), a via 33A (e.g., a metal post connecting MT2 to MT1), and an intermediary section 33C (e.g., on MT1).

The first section 310A includes a conductive trace 310A-1 on the first conductive layer (e.g., MT1). The second section 310B includes a conductive trace 310B-1 on the second conductive layer (e.g., MT2). The third section 310C includes a conductive trace 310C-1 on the first conductive layer (e.g., MT1). Each of the intermediary sections 31B, 31C, 33B, and 33C includes a conductive trace 31B-1, 31C-1, 33B-1, and 33C-1, respectively.

The conductive trace 310A-1 is connected to the conductive trace 310B-1 using the conductive trace 31B-1, the via 31A, and the conductive trace 31C-1. The conductive trace 310B-1 is connected to the conductive trace 310C-1 using the conductive trace 33B-1, the via 33A and the conductive trace 33C-1. A signal on the first element 310 can pass from the first port 31, to the conductive trace 310A-1, to the conductive trace 31B-1, to the via 31A, to the conductive trace 31C-1, to the conductive trace 310B-1, to the conductive trace 33B-1, to the via 33A, to the conductive trace 33C-1, to the conductive trace 310C-1, and then to the third port 33. These elements (the first port 31, the conductive trace 310A-1, the conductive trace 31B-1, the via 31A, the conductive trace 31C-1, the conductive trace 310B-1, the conductive trace 33B-1, the via 33A, the conductive trace 33C-1, the conductive trace 310C-1, and the third port 33) are connected in series in that order.

Referring to FIGS. 3B and 3C, the second element 320 includes a first conductive layer (e.g., a first metal layer, MT1), a second conductive layer (e.g., a second metal layer, MT2), a third conductive layer 330 (e.g., a third metal layer, MT0), a first dielectric layer (e.g., a layer 640 in FIG. 6) between the first conductive layer (e.g., MT1) and third conductive layer (e.g., MT0), and a second dielectric layer (e.g., a layer 650 in FIG. 6) between the second conductive layer (e.g., MT2) and the first conductive layer (e.g., MT1).

As for the second element 320, the fourth section 320A is on the second conductive layer (e.g., MT2), the fifth section 320B is on the first conductive layer (e.g., MT1), and the sixth section 320C is on the second conductive layer (e.g., MT2). The fourth section 320A is connected to the fifth section 320B using an intermediary section 34B (e.g., on MT2), a via 34A (e.g., a metal post connecting MT2 to MT1), and an intermediary section 34C (e.g., on MT1). The fifth section 320B is connected to the sixth section 320C using an intermediary section 328 (e.g., on MT1), a via 32A (e.g., a metal post connecting MT1 to MT2), and an intermediary section 32C (e.g., on MT2).

The fourth section 320A includes a conductive trace 320A-1 on the second conductive layer (e.g., MT2). The fifth section 320B includes a conductive trace 320B-1 on the first conductive layer (e.g., MT1). The third section 320C includes a conductive trace 320C-1 on the second conductive layer (e.g., MT2). Each of the intermediary sections 34B, 34C, 32B, and 32C includes a conductive trace 34B-1, 34C-1, 32B-1, and 32C-1, respectively.

The conductive trace 320A-1 is connected to the conductive trace 320B-1 using the conductive trace 34B-1, the via 34A, and the conductive trace 34C-1. The conductive trace 320B-1 is connected to the conductive trace 320C-1 using the conductive trace 32B-1, the via 32A, and the conductive trace 32C-1. A signal on the second element 320 can pass from the fourth port 34, to the conductive trace 320A-1, to the conductive trace 34B-1, to the via 34A, to the conductive trace 34C-1, to the conductive trace 320B-1, to the conductive trace 32B-1, to the via 32A, to the conductive trace 32C-1, to the conductive trace 320C-1, and then to the second port 32. These elements (the fourth port 34, the conductive trace 320A-1, the conductive trace 34B-1, the via 34A, the conductive trace 34C-1, the conductive trace 320B-1, the conductive trace 32B-1, the via 32A, the conductive trace 32C-1, the conductive trace 320C-1, and the second port 32) are connected in series in that order.

The orientations of the conductive traces are described for this particular example. The conductive trace 31B-1 is aligned to the conductive trace 310A-1 (i.e., there is no rotation between the conductive trace 310A-1 and the conductive trace 31B-1). The conductive trace 31C-1 is rotated 90 degrees from the conductive trace 31B-1. The conductive trace 310B-1 is rotated 90 degrees from the conductive trace 31C-1. The conductive trace 33B-1 is rotated 90 degrees from the conductive trace 310B-1. The conductive trace 33C-1 is rotated 90 degrees from the conductive trace 33B-1. There is no rotation between the conductive trace 33C-1 and the conductive trace 310C-1. When a first trace is rotated 90 degrees from a second trace, the first trace and the second trace are perpendicular. The conductive traces 310A-1, 31B-1, 310B-1, 33C-1, and 310C-1 are parallel, and these are perpendicular to conductive traces 31C-1 and 33B-1.

In this particular example, there is no rotation between the conductive trace 320A-1 and the conductive trace 34B-1. The conductive trace 34C-1 is rotated 90 degrees from the conductive trace 34B-1. The conductive trace 320B-1 is rotated 90 degrees from the conductive trace 34C-1. The conductive trace 32B-1 is rotated 90 degrees from the conductive trace 320B-1. The conductive trace 32C-1 is rotated 90 degrees from the conductive trace 32B-1. There is no rotation between the conductive trace 32C-1 and the conductive trace 320C-1. The conductive traces 320A-1, 3413-1, 320B-1, 32C-1, and 320C-1 are parallel, and these are perpendicular to conductive traces 34C-1 and 32B-1. The conductive traces 310A-1, 31B-1, 310B-1, 33C-1, 310C-1, 320A-1, 3413-1, 320B-1, 32C-1, and 320C-1 are parallel. It should be noted that the subject technology is not limited to these particular orientations.

In FIGS. 3A and 3B, the sections (e.g., 310A/320A and 310C/320C) for phase matching do not overlap vertically. For instance, the conductive trace 310A-1 of the first section 310A (on MT1) does not overlap the conductive trace 320A-1 of the fifth section 320A (on MT2) vertically, and these sections do not provide signal coupling. A lateral gap G1 exists between the conductive trace 310A-1 and the conductive trace 320A-1. The lateral gap G1 is constant along the substantially entire length (or along the majority of the length) of the first/fourth section (310A/320A) in this example. The conductive trace 310C-1 of the third section 310C (on MT1) does not overlap the conductive trace 320C-1 of the sixth section 320C (on MT2) vertically, and these sections do not provide signal coupling. A lateral gap G2 exists between the conductive trace 310C-1 and the conductive trace 320C-1. The lateral gap G2 is constant along the substantially entire length (or along the majority of the length) of the third/sixth section (310C/320C). In one example, the lateral gap G1 is the same as the lateral gap G2.

In another embodiment, the conductive traces of the sections for phase matching may overlap vertically (partially or completely). In that instance, the conductive traces of the sections for phase matching may provide phase matching as well as signal coupling (e.g., a conductive trace 310A-1 overlaps a conductive trace 320A-1 vertically, and a conductive trace 310C-1 overlaps a conductive trace 320C-1 vertically).

Still referring to FIGS. 3A and 3B, the conductive traces of the conductive-layer inversion sections (e.g., 310B and 320B) overlap vertically in this example. For instance, the second section 310B overlaps vertically the fifth section 320B. In other words, the conductive trace 310B-1 (on MT2) overlaps vertically the conductive trace 320B-1 (on MT1). When the conductive traces overlap, such overlap may be a partial overlap or a complete overlap within the sections.

The impedance is determined by, among others, the distance between a conductive trace and a ground plane. Referring to FIGS. 3B and 3C, the width of a conductive trace on a lower conductive layer (e.g., MT1) is less than the width of a conductive trace on a upper conductive layer (e.g., MT2) to provide matching impedance. Since MT1 is closer to the ground plane MT0 than MT2, the width of MT1 is less than the width of MT2.

For instance, the width W310A of the conductive trace 310A-1 (on MT1) in the first section 310A is less than the width W320A of the conductive trace 310A-1 (on MT2) in the fourth section 320A. The width W310C of the conductive trace 310C-1 (on MT1) in the third section 310C is less than the width W320C of the conductive trace 320C-1 (on MT2) of the sixth section 320C (on MT2). In this particular example, within the sections 310B and 320B, the width W320B of the conductive trace 320B-1 is less than the width W310B of the conductive trace 310B-1. The width W310B is less than each of the width W310A and the width W310C. The width W320B is less than each of the width W320A and the width W320C.

In this particular example, each width W310A, W310B, W310C, W320A, W320B, W320C is constant along the substantially entire length (or along the majority of the length) of its corresponding section.

Furthermore, the length of the second section 310B is less than the combined length of the first section 310A and the third section 310C. In other words, the length of the conductive trace 310B-1 is less than the combined length of the conductive trace 310A-1 and the conductive trace 310C-1.

In this particular example, the length of the second section 310B is less than each of the length of the first section 310A and the length of the third section 310C. In other words, the length of the conductive trace 310B-1 is less than each of the length of the conductive trace 310A-1 and the length of the conductive trace 310C-1.

In addition, the length of the fifth section 320B is less than the combined length of the fourth section 320A and the sixth section 320C. In other words, the length of the conductive trace 320B-1 is less than the combined length of the conductive trace 320A-1 and the conductive trace 320C-1.

In this particular example, the length of the fifth section 320B is less than each of the length of the fourth section 320A and the length of the sixth section 310C. In other words, the length of the conductive trace 320B-1 is less than each of the length of the conductive trace 320A-1 and the length of the conductive trace 320C-1.

In one embodiment, the length of the first section 310A (or the length of the conductive trace 310A-1) may be the same as (e.g., substantially the same as) the length of the third section 310C (or the length of the conductive trace 310C-1). In another embodiment, the length of the first section 310A (or the length of the conductive trace 310A-1) may be different from the length of the third section 310C (or the length of the conductive trace 310C-1).

In one embodiment, the length of the fourth section 320A (or the length of the conductive trace 320A-1) may be the same as (e.g., substantially the same as) the length of the sixth section 320C (or the length of the conductive trace 320C-1). In another embodiment, the length of the fourth section 320A (or the length of the conductive trace 320A-1) may be different from the length of the sixth section 320C (or the length of the conductive trace 320C-1).

In one embodiment, each length of 31B-1, 31C-1, 33B-1, 33C-1, 34B-1, 34C-1, 32B-1, and 32C-1 is less than (e.g., less than 1/16, 1/8 or 1/4 of) any of the length of the conductive traces 310A-1, 310B-1, 310C-1, 320A-1, 320B-1, and 320C-1.

An RF signal combiner 300 can provide controlled coupling (e.g., desired or intentional cross-talk) by having, for example, controlled coupling of the second section 310B and the fifth section 320B (i.e., controlled coupling of the signals on the conductive traces 310B-1 and 320B-1).

In FIGS. 3B and 3C, an overlay coupler (i.e., sections 310B/320B) overlaps vertically and provides conductive-layer inversion. This is highly desirable for Butler matrix designs in multilayer microstrip substrates. This coupler has the following properties:

dB(S(33,31))=dB(S(34,31)) AND phase(S(33,31))=phase (S(32,34))

dB(S(34,31))=dB(S(32,33)) AND phase(S(34,31))=phase (S(32,33)).

In other words, the amplitude difference between the third port 33 and the first port 31 is the same as (e.g., is substantially the same as, is matched with, or is substantially matched with) the amplitude difference between the fourth port 34 and the first port 31.

The phase difference between the third port 33 and the first port 31 is the same as (e.g., is substantially the same as, is matched with, or is substantially matched with) the phase difference between the second port 32 and the fourth port 34.

The amplitude difference between the fourth port 34 and the first port 31 is the same as (e.g., is substantially the same as, is matched with, or is substantially matched with) the amplitude difference between the second port 32 and the third port 33.

The phase difference between the fourth port 34 and the first port 31 is the same as (e.g., is substantially the same as, is matched with, or is substantially matched with) the phase difference between the second port 32 and the third port 33.

Figure 4A:
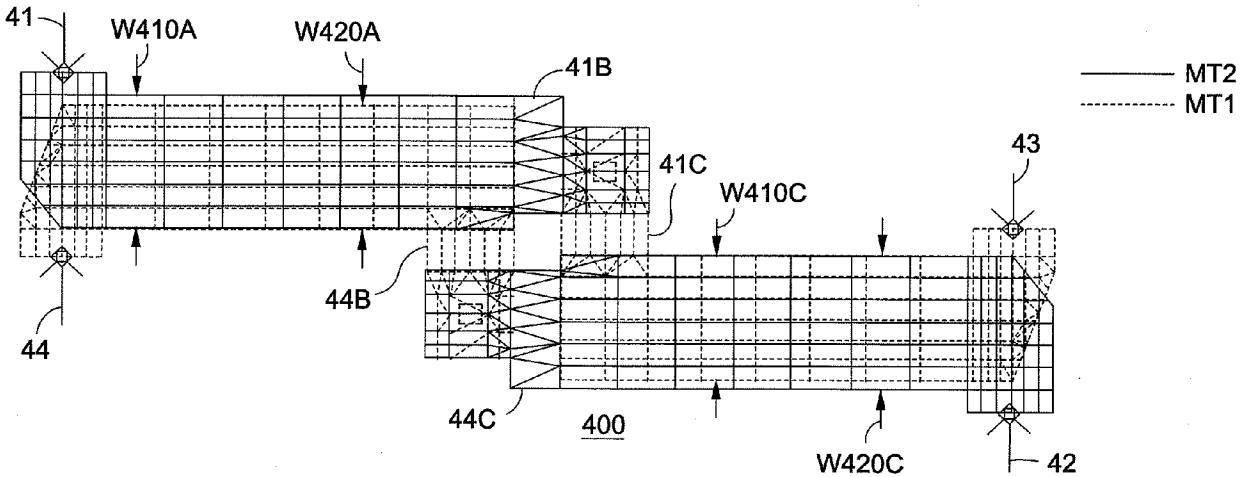
FIG. 4A is a diagrammatic top-down view depicting another example of an RF signal combiner.
Figure 4B:
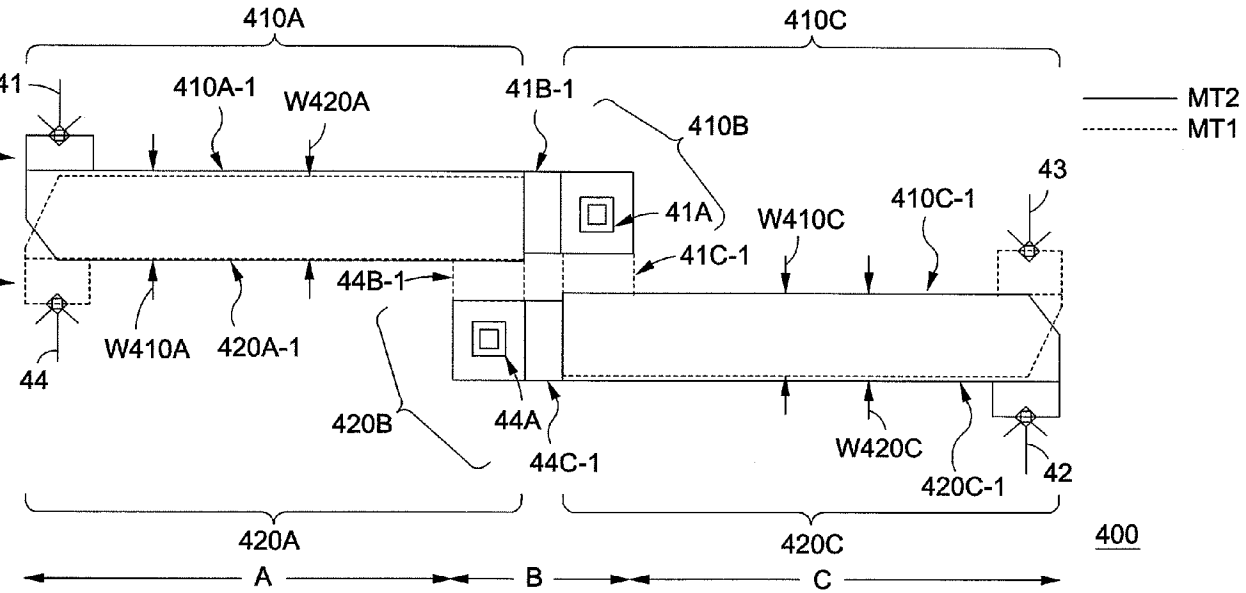
FIG. 4B is another diagrammatic top-down view of an RF signal combiner of FIG. 4A.
Figure 4C:
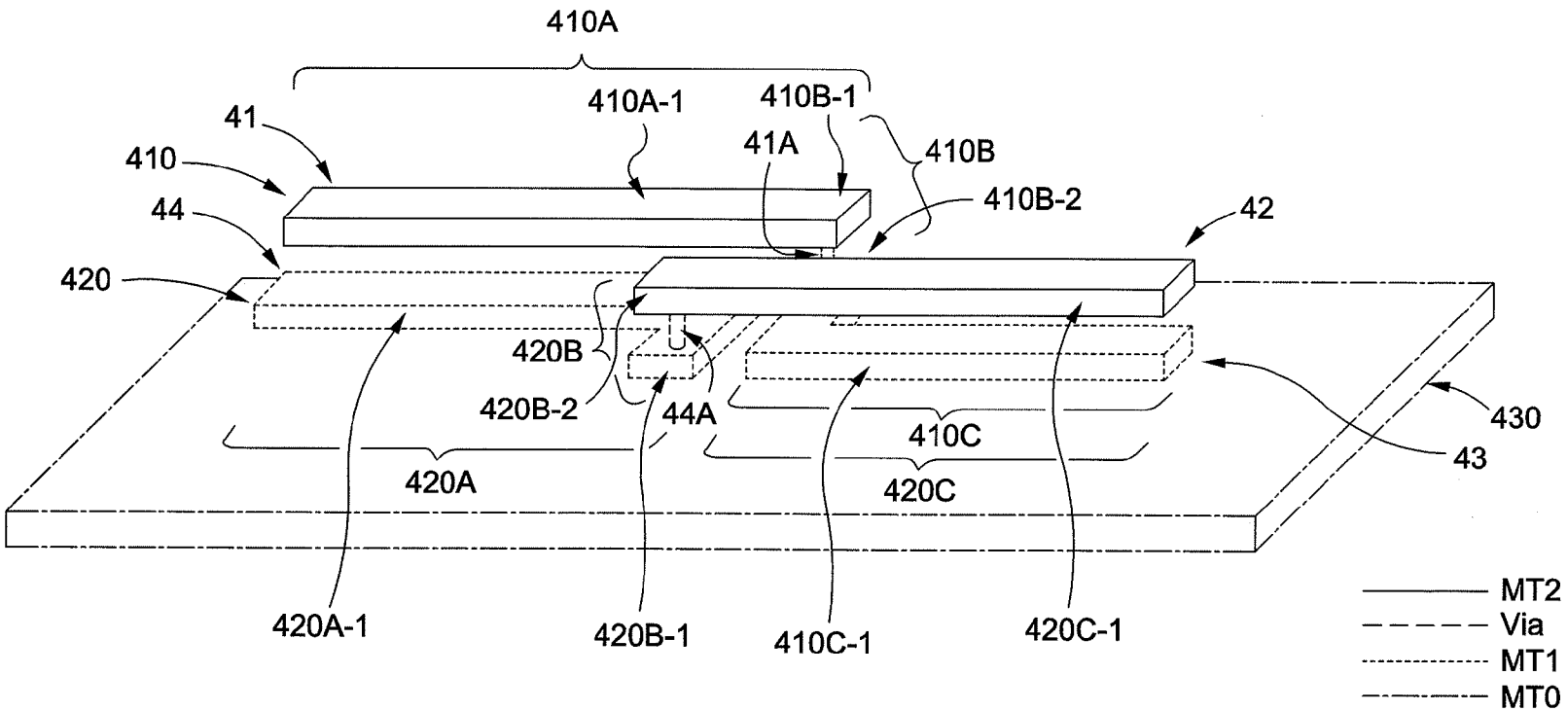
FIG. 4C is a diagrammatic perspective view depicting an example of the RF signal combiner shown in FIG. 4B.

FIGS. 4A and 4B are diagrammatic top-down views depicting another example of a radio frequency (RF) signal combiner. FIG. 4C is a diagrammatic perspective view depicting an example of the RF signal combiner shown in FIG. 4B. Referring to FIGS. 4A, 4B and 4C, an RF signal combiner 400 includes a first element 410 and a second element 420. Each of the first element 410 and the second element 420 may include a phase matching section, a conductive-layer inversion section, and a signal coupling section. One or more sections may overlap or provide multiple functionalities. In this embodiment, one section acts as a signal coupling section as well as a phase matching section.

The first element 410 includes a first port (e.g., an input port) 41, a first section 410A for signal coupling as well as phase matching, a second section 410B for conductive-layer inversion, a third section 410C for signal coupling as well as phase matching, and a third port (e.g., a through port) 43. Each of the first and third sections 410A and 410C can act as a signal coupling section as well as a phase matching section, and the second section 410B can act as a conductive-layer inversion section. The first element 410 may further include intermediary sections 41B and 41C.

The second element 420 includes a fourth port (e.g., a coupled port) 44, a fourth section 420A for signal coupling as well as phase matching, a fifth section 420B for conductive-layer inversion, a sixth section 420C for signal coupling as well as phase matching, and a second port (e.g., an isolated port) 42. Each of the fourth and sixth sections 420A and 420C can thus act as a signal coupling section as well as a phase matching section, and the fifth section 420B can act as a conductive-layer inversion section. The second element 420 may further include intermediary sections 44B and 44C.

The RF signal combiner 400 may allow a signal from an input port 41 to pass through the through port 43 and may substantially isolate a signal from the input port 41 and the coupled port 44 from passing through the isolated port 42. The RF signal combiner 400 may allow a signal from an input port 41 to be coupled to the coupled port 44.

The first section 410A and the fourth section 420A are in a first region A of the RF signal combiner 400, the second section 410B and the fifth section 420B are in a second region B of the RF signal combiner 400, and the third section 410C and the sixth section 420C are in a third region C of the RF signal combiner 400. The last portions of the first section 410A and the fourth section 420A are in the second region B, and the first portions of the third section 410C and the sixth section 420C are in the second region B.

Referring to FIGS. 4A, 4B, and 4C, the first element 410 includes a first conductive layer (e.g., a first metal layer, MT1), a second conductive layer (e.g., a second metal layer, MT2), a third conductive layer 430 (e.g., a third metal layer, MT0), a first dielectric layer (e.g., a layer 640 in FIG. 6) between the first conductive layer (e.g., MT1) and third conductive layer (e.g., MT0), and a second dielectric layer (e.g., a layer 650 in FIG. 6) between the second conductive layer (e.g., MT2) and the first conductive layer (e.g., MT1). In this example, the second conductive layer is disposed above the first conductive layer, and the first conductive layer is disposed above the third conductive layer.

As for the first element 410, the first section 410A is on MT2, the second section 410B is on both MT2 and MT1, and the third section 410C is on MT1. In the second section 410B, MT2 is connected to MT1 using a via 41A (e.g., a metal post connecting MT2 to MT1). The first section 410A is connected to the second section 410B using the intermediary section 41B. The second section 410B is connected to the third section 410C using the intermediary section 41C.

The first section 410A includes a conductive trace 410A-1 on the second conductive layer (e.g., MT2). The second section 410B includes a conductive trace 410B-1 on the second conductive layer (e.g., MT2), a via 41A, and a conductive trace 410B-2 on the first conductive layer (e.g., MT1). The conductive trace 410B-1 is connected to the conductive trace 410B-2 through the via 41A. The third section 410C includes a conductive trace 410C-1 on the first conductive layer (e.g., MT1). The intermediary section 41B includes a conductive trace 41B-1 on the second conductive layer (e.g., MT2). The intermediary section 41C includes a conductive trace 41C-1 on the first conductive layer (e.g., MT1).

The conductive trace 410A-1 is connected to the conductive trace 41B-1, which is connected to the conductive trace 410B-1, which is connected to the via 41A, which is connected to the conductive trace 410B-2, which is connected to the conductive trace 41C-1, which is connected to the conductive trace 410C-1. A signal on the first element 410 can pass from the first port 41, to the conductive trace 410A-1, to the conductive trace 41B-1, to the conductive trace 410B-1, to the via 41A, to the conductive trace 410B-2, to the conductive trace 41C-1, to the conductive trace 410C-1, and then to the third port 43. These elements (the first port 41, the conductive trace 410A-1, the conductive trace 41B-1, the conductive trace 410B-1, the via 41A, the conductive trace 410B-2, the conductive trace 41C-1, the conductive trace 410C-1, and the third port 43) are connected in series in that order.

Referring to FIGS. 4A, 4B, and 4C, the second element 420 includes a first conductive layer (e.g., a first metal layer, MT1), a second conductive layer (e.g., a second metal layer, MT2), a third conductive layer 430 (e.g., a third metal layer, MT0), a first dielectric layer (e.g., a layer 640 in FIG. 6) between the first conductive layer (e.g., MT1) and third conductive layer (e.g., MT0), and a second dielectric layer (e.g., a layer 650 in FIG. 6) between the second conductive layer (e.g., MT2) and the first conductive layer (e.g., MT1).

As for the second element 420, the fourth section 420A is on MT1, the fifth section 420B is on both MT1 and MT2, and the sixth section 420C is on MT2. In the fifth section 420B, MT1 is connected to MT2 using a via 44A (e.g., a metal post connecting MT1 to MT2). The fourth section 420A is connected to the fifth section 420B, and the fifth section 420B is connected to the sixth section 420C. The fourth section 420A is connected to the fifth section 420B using the intermediary section 44B. The fifth section 420B is connected to the sixth section 420C using the intermediary section 44C.

The fourth section 420A includes a conductive trace 420A-1 on the first conductive layer (e.g., MT1). The fifth section 420B includes a conductive trace 420B-1 on the first conductive layer (e.g., MT1), a via 44A, and a conductive trace 420B-2 on the second conductive layer (e.g., MT2). The conductive trace 420B-1 is connected to the conductive trace 420B-2 through the via 44A. The third section 420C includes a conductive trace 420C-1 on the second conductive layer (e.g., MT2). The intermediary section 44B includes a conductive trace 44B-1 on the first conductive layer (e.g., MT1). The intermediary section 44C includes a conductive trace 44C-1 on the second conductive layer (e.g., MT2).

The conductive trace 420A-1 is connected to the conductive trace 44B-1, which is connected to the conductive trace 420B-1, which is connected to the via 44A, which is connected to the conductive trace 420B-2, which is connected to the conductive trace 44C-1, which is connected to the conductive trace 420C-1. A signal on the second element 420 can pass from the fourth port 44, to the conductive trace 420A-1, to the conductive trace 44B-1, to the conductive trace 420B-1, to the via 44A, to the conductive trace 420B-2, to the conductive trace 44C-1, to the conductive trace 420C-1, and then to the second port 42. These elements (the fourth port 44, the conductive trace 420A-1, the conductive trace 44B-1, the conductive trace 420B-1, the via 44A, the conductive trace 420B-2, the conductive trace 44C-1, the conductive trace 420C-1, and the second port 42) are connected in series in that order.

In this example, the conductive trace 410A-1 is disposed vertically above the conductive trace 420A-1, the conductive trace 410B-1 is disposed vertically above the conductive trace 41013-2, the conductive trace 420B-2 is are disposed vertically above the conductive trace 420B-1, and the conductive trace 420C-1 is disposed vertically above the conductive trace 410C-1.

In this particular example, there is no rotation between the conductive trace 410A-1 and the conductive trace 41B-1. There is no rotation between the conductive trace 410B-1 and the conductive trace 41B-1, The conductive trace 410B-2 is rotated 90 degrees from the conductive trace 41013-1. There is no rotation between the conductive trace 41C-1 and the conductive trace 410B-2. The conductive trace 410C-1 is rotated 90 degrees from the conductive trace 41C-1. When a first trace is rotated 90 degrees from a second trace, the first trace and the second trace are perpendicular. When there is no rotation between the two traces, the traces are parallel. The conductive traces 410A-1, 41B-1, 410B-1, and 410C-1 are parallel, and these are perpendicular to conductive traces 410B-2 and 41C-1.

In this particular example, the conductive trace 44B-1 is rotated 90 degrees from the conductive trace 420A-1. There is no rotation between the conductive trace 420B-1 and the conductive trace 44B-1. The conductive trace 420B-2 is rotated 90 degrees from the conductive trace 420B-1. There is no rotation between the conductive trace 44C-1 and the conductive trace 420B-2. There is no rotation between the conductive trace 420C-1 and the conductive trace 44C-1. The conductive traces 420A-1, 420B-2, 44C-1, and 420C-1 are parallel, and these are perpendicular to conductive traces 44B-1 and 420B-1. The conductive traces 410A-1, 41B-1, 410B-1, 410C-1, 420A-1, 420B-2, 44C-1, and 420C-1 are parallel.

In FIGS. 4A, 4B, and 4C, the sections (e.g., 410A/420A and 410C/420C) for signal coupling and phase matching overlap vertically. For instance, the conductive trace 410A-1 of the first section 410A (on MT2) overlaps the conductive trace 420A-1 of the fifth section 420A (on MT1) vertically so that the signals traveling on 410A-1 and 420A-1 in sections 410A and 420A are coupled. The conductive trace 410C-1 of the third section 410C (on MT1) overlaps the conductive trace 420C-1 of the sixth section 420C (on MT2) vertically so that the signals traveling on 410C-1 and 420C-1 in sections 410C and 420C are coupled. When the conductive traces overlap (or the sections overlap) vertically, such overlap may be a partial overlap or a complete overlap.

In another embodiment, the conductive traces of the sections for signal coupling and/or phase matching do not overlap. The conductive traces of the sections for signal coupling may provide signal coupling without having the conductive traces of the sections overlap vertically (e.g., a conductive trace 410A-1 does not overlap a conductive trace 420A-1 vertically, and a conductive trace 410C-1 does not overlap a conductive trace 420C-1 vertically).

In addition, the conductive traces of the sections for phase matching may provide phase matching without having the conductive traces of the sections overlap vertically (e.g., a conductive trace 410A-1 does not overlap a conductive trace 420A-1 vertically, and a conductive trace 410C-1 does not overlap a conductive trace 420C-1 vertically).

Still referring to FIGS. 4A, 4B, and 4C, the conductive layers (MT1 and MT2) in each of the conductive-layer inversion sections (e.g., 41013 and 420B) overlap vertically in this example. For instance, in the second section 410B, the conductive trace 410B-1 (on MT2) overlaps vertically the conductive trace 41013-2 (on MT1). In the fifth section 420B, the conductive trace 420B-1 (on MT1) overlaps vertically the conductive trace 420B-2 (on MT2). When the conductive traces overlap, such overlap may be a partial overlap or a complete overlap within the section.

The impedance is determined by, among others, the distance between a conductive trace and a ground plane. Referring to FIGS. 4A, 4B, and 4C, the width of a conductive trace on a lower conductive layer (e.g., MT1) is less than the width of a conductive trace on a upper conductive layer (e.g., MT2) to provide matching impedance. Since MT1 is closer to the ground plane MT0 than MT2, the width of MT1 is less than the width of MT2.

For instance, the width W420A of the conductive trace 420A-1 (on MT1) in the fourth section 420A is less than the width W410A of the conductive trace 410A-1 (on MT2) in the first section 410A. The width W410C of the conductive trace 410C-1 (on MT1) in the third section 410C is less than the width W420C of the conductive trace 420C-1 (on MT2) of the sixth section 420C.

In this particular example, within the second section 410B, the size (e.g., width or length) of the conductive trace 410B-1 is the same as (e.g., is substantially the same as) the size (e.g., length or width, respectively) of the conductive trace 410B-2. In addition, within the fifth section 420B, the size (e.g., width or length) of the conductive trace 420B-1 is the same (e.g., is substantially the same as) as the size (e.g., length or width, respectively) of the conductive trace 420B-2.

In this particular example, the width of the conductive trace 410B-1 is less than the width W410A, and the width of the conductive trace 410B-1 is less than the width W410C. The width of the conductive trace 420B-1 is less than the width W420A, and the width of the conductive trace 420B-1 is less than the width W420C. Each width W410A, W410C, W420A, W420C is constant along the substantially entire length (or along the majority of the length) of its corresponding section. Each of the width of the conductive traces 410B-1, 410B-2, 420B-1 and 420B-2 is constant along the substantially entire length (or along the majority of the length) of its corresponding section.

Furthermore, the length of the second section 410B is less than the combined length of the first section 410A and the third section 410C. In other words, the length of the conductive trace 410B-1 or 410B-2 is less than the combined length of the conductive trace 410A-1 and the conductive trace 410C-1.

In this particular example, the length of the second section 410B is less than each of the length of the first section 410A and the length of the third section 410C. In other words, the length of the conductive trace 41013-1 or 410B-2 is less than each of the length of the conductive trace 410A-1 and the length of the conductive trace 410C-1.

In one embodiment, the length of the first section 410A (or the length of the conductive trace 410A-1) may be the same as (e.g., substantially the same as) the length of the third section 410C (or the length of the conductive trace 410C-1). In another embodiment, the length of the first section 410A (or the length of the conductive trace 410A-1) may be different from the length of the third section 410C (or the length of the conductive trace 410C-1). In one embodiment, the length of the fourth section 420A (or the length of the conductive trace 420A-1) may be the same as (e.g., substantially the same as) the length of the sixth section 420C (or the length of the conductive trace 420C-1). In another embodiment, the length of the fourth section 420A (or the length of the conductive trace 420A-1) may be different from the length of the sixth section 420C (or the length of the conductive trace 420C-1).

In one embodiment, each of the length of 41B-1, 41C-1, 44B-1, and 44C-1 is less than (e.g., less than 1/16, 1/8, 1/4 or 1/2 of) any of the length of the conductive traces 410A-1, 410B-1, 410B-2, 410C-1, 420A-1, 420B-1, 420B-2, and 420C-1.

An RF signal combiner 400 can provide controlled coupling (e.g., desired or intentional cross-talk) by having, for example, controlled coupling of the first section 410A and the fourth section 420A (i.e., controlled coupling of the signals on the conductive traces 410A-1 and 420A-1) and controlled coupling of the third section 410C and the sixth section 420C (i.e., controlled coupling of the signals on the conductive traces 410C-1 and 420C-1).

In FIGS. 4A, 4B, and 4C, an overlay coupler (i.e., sections 410A/420A and 410C/420C) is symmetric for all ports. This is highly desirable for Butler matrix designs in multilayer microstrip substrates. This coupler has the following properties:

dB(S(43,41))=dB(S(44,41)) AND phase(S(43,41))=phase (S(42,44))

dB(S(44,41))=dB(S(42,43)) AND phase(S(44,41))=phase (S(42,43)).

In other words, the amplitude difference between the third port 43 and the first port 41 is the same as (e.g., is substantially the same as, is matched with, or is substantially matched with) the amplitude difference between the fourth port 44 and the first port 41.

The phase difference between the third port 43 and the first port 41 is the same as (e.g., is substantially the same as, is matched with, or is substantially matched with) the phase difference between the second port 42 and the fourth port 44.

The amplitude difference between the fourth port 44 and the first port 41 is the same as (e.g., is substantially the same as, is matched with, or is substantially matched with) the amplitude difference between the second port 42 and the third port 43.

The phase difference between the fourth port 44 and the first port 41 is the same as (e.g., is substantially the same as, is matched with, or is substantially matched with) the phase difference between the second port 42 and the third port 43.

In other microstrip overlay couplers (unlike those shown in FIGS. 3A, 3B, 4A, 4B, and 4C), the top metal line path (e.g., MT2) may be electrically shorter in phase when compared to an embedded metal line path (e.g., MT1). In addition, the top metal line losses can be different than the embedded metal line losses due to line width differences and/or metal thickness differences due to process or other factors. This greatly affects Butler matrix performance since many of these types of couplers used are cascade (e.g., multiple RF signal combiner are placed in series). Minute phase differences can produce an accumulative effect and can become very large in a Butler matrix and lead to amplitude variations across the antenna ports as well as phase differences. By dividing a coupler in half and flipping on half relative to the other, as shown in FIGS. 4A, 4B, and 4C, identical losses and phase lengths can be achieved for both the through port 43 and the coupled port 44.

Figure 5A:
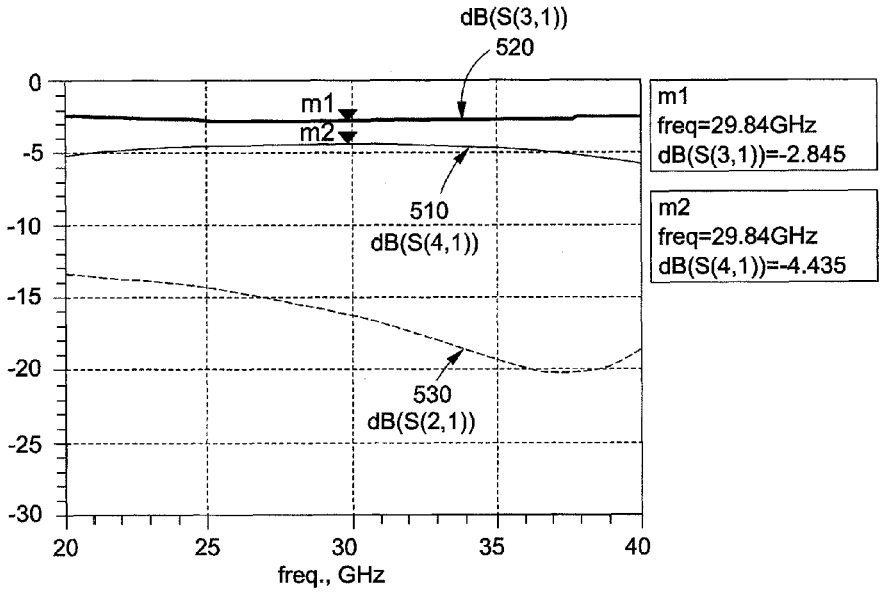
FIG. 5A illustrates an example of amplitude variations resulting from the RF signal combiner shown in FIGS. 4A, 4B, and 4C.

FIG. 5A illustrates an example of amplitude variations resulting from the RF signal combiner shown in FIGS. 4A, 4B, and 4C. A curve labeled dB(S(4,1)) 510 illustrates an amplitude difference between the fourth port 44 (a coupled port) and the first port 41 (an input port), and it varies between about −4.4 dB to −6 dB over the frequency range of 20 GHz to 40 GHz. A curve labeled dB(S(3,1)) 520 illustrates an amplitude difference between the third port 43 (a through port) and the first port 41 (an input port), and it varies between about −2.5 dB to −3 dB over the frequency range of 20 GHz to 40 GHz. The difference between dB(S(4,1)) 510 and dB(S(3,1)) 520 is about 2 dB to 3 dB. A curve labeled db(S(2,1)) 530 illustrates an amplitude difference between the second port 42 (an isolated port) and the first port 41 (an input port), and it varies between about −13.5 dB to −20.5 dB over the frequency range of 20 GHz to 40 GHz.

Figure 5B:
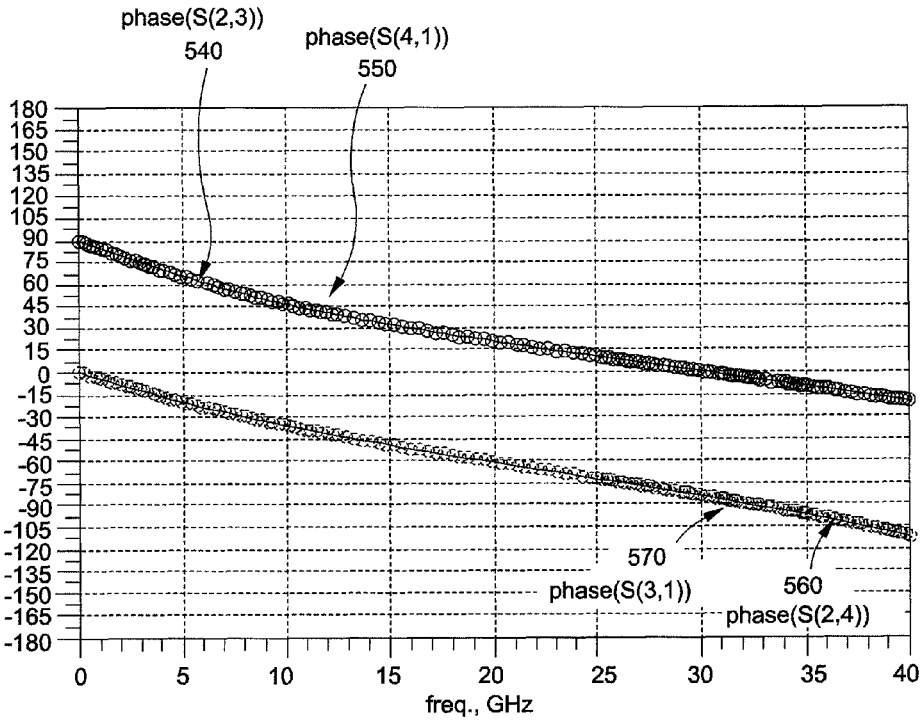
FIG. 5B illustrates an example of phase differences resulting from the RF signal combiner shown in FIGS. 4A, 4B, and 4C.

FIG. 5B illustrates an example of phase differences resulting from the RF signal combiner shown in FIGS. 4A, 4B, and 4C. A curve labeled phase(S(2,3)) 540 illustrates a phase difference between the second port 42 (an isolated port) and the third port 43 (a through port), and it varies between about 90 degrees to −10 degrees over the frequency range of less than 1 GHz to 40 GHz. A curve labeled phase(S(4,1)) 550 illustrates a phase difference between the fourth port 44 (a coupled port) and the first port 41 (an input port), and it varies between about 90 degrees to −10 degrees over the frequency range of less than 1 GHz to 40 GHz. The curves 540 and 550 are the same, indicating that the phase difference between the second port 42 and the third port 43 is the same as (e.g., is substantially the same as, is matched with, or is substantially matched with) the phase difference between the fourth port 44 and the first port 41.

A curve labeled phase(S(2,4)) 560 illustrates a phase difference between the second port 42 (an isolated port) and the fourth port 44 (a coupled port), and it varies between about 0 degree to −100 degrees over the frequency range of less than 1 GHz to 40 GHz. A curve labeled phase(S(3,1)) 570 illustrates a phase difference between the third port 43 (a through port) and the first port 41 (an input port), and it varies between about 0 degree to −100 degrees over the frequency range of less than 1 GHz to 40 GHz. The curves 560 and 570 are the same, indicating that the phase difference between the second port 42 and the fourth port 44 is the same as (e.g., is substantially the same as, is matched with, or is substantially matched with) the phase difference between the third port 43 and the first port 41.

Still referring to FIG. 5B, a 90-degree phase shift exists between the curve 540 (the phase difference between the second port 42 and the third port 43) and the curve 560 (the phase difference between the second port 42 and the fourth port 44) constantly over the frequency range of, for example, less than 1 GHz to 40 GHz. A 90-degree phase shift exists between the curve 540 (the phase difference between the second port 42 and the third port 43) and the curve 570 (the phase difference between the third port 43 and the first port 41) constantly over the frequency range of less than 1 GHz to 40 GHz.

A 90-degree phase shift exists between the curve 550 (the phase difference between the fourth port 44 and the first port 41) and the curve 560 (the phase difference between the second port 42 and the fourth port 44) constantly over the frequency range of less than 1 GHz to 40 GHz. A 90-degree phase shift exists between the curve 550 (the phase difference between the fourth port 44 and the first port 41) and the curve 570 (the phase difference between the third port 43 and the first port 41) constantly over the frequency range of less than 1 GHz to 40 GHz.

Figure 6:
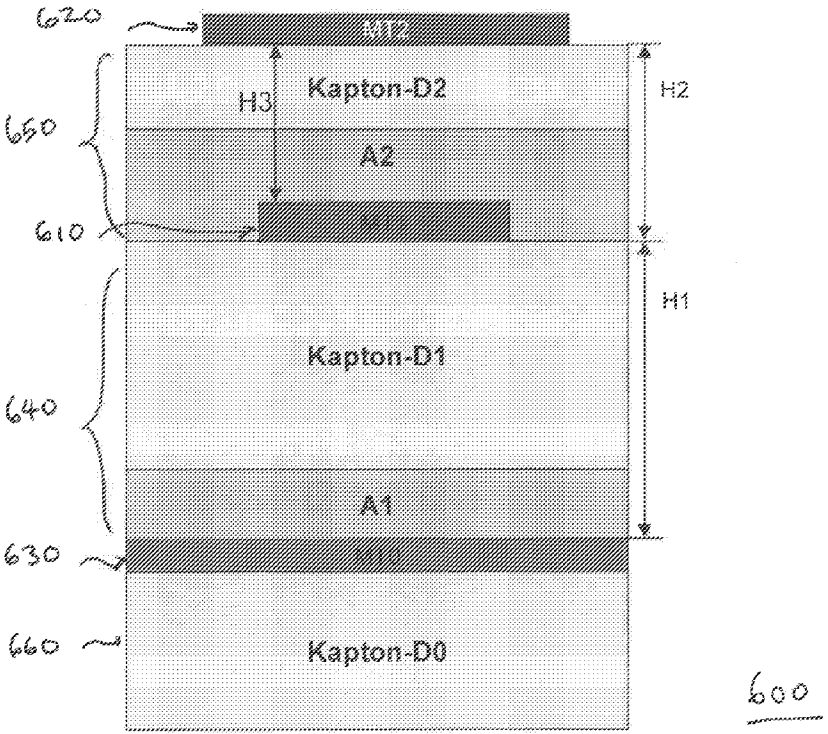
FIG. 6 is a diagrammatic cross-sectional view depicting an example of an RF signal combiner.

FIG. 6 is a diagrammatic cross-sectional view depicting an example of an RF signal combiner. An RE signal combiner 600 (which can be, for example, an RE signal combiner 300 or 400) includes a first conductive layer 610 (e.g., a first metal layer, MT1), a second conductive layer 620 (e.g., a second metal layer, MT2), a third conductive layer 630 (e.g., a third metal layer, MT0), a first dielectric layer 640 between the first conductive layer 610 (e.g., MT1) and the third conductive layer 630 (e.g., MT0), and a second dielectric layer 650) between the second conductive layer 620 (e.g., MT2) and the first conductive layer 610 (e.g., MT1). The RE signal combiner 600 may also include a physical support layer 660 below the third conductive layer 630.

In this example, the layers are disposed vertically in the following order, from the bottom-most layer to the top-most layer. The physical support layer 660, the third conductive layer 630, the first dielectric layer 640, the first conductive layer 610, the second dielectric layer 650, and the second conductive layer 620. The first conductive layer 610 is disposed between the second conductive layer 620 and the third conductive layer 630. The subject technology is, however, not limited to this particular stacking order.

The first and second dielectric layer 640 and 650 may be made of the same or different materials. Each of the dielectric layers 640 and 650 may be made of an organic material(s) such as a polyimide. Each of the first and second dielectric layer 640 and 650 may include one or more layers. In this example, the first dielectric layer 640 includes an adhesive layer A1 and a dielectric film D1). the second dielectric layer 650 includes an adhesive layer A2 and a dielectric film. The physical support layer 660 may be also a polyimide film. It is desirable to use low tan δ material (loss tangent) for A1, D1, A2, D2 and D0 to minimize the loss of a signal in the material.

The thickness (H1) of the dielectric layer 640 may be less than 4 mils, the thickness (H2) of the dielectric layer 650 may be 2 mils and the distance (H3) between the top of the first conductive layer 610 and the bottom of the second conductive layer 620 may be 1 mil according to one example. The subject technology is, however, not limited to the values described above.

According to one embodiment, the width of a conductive trace on any of the conductive layers 610, 620 and 630 is preferably within the tolerance of +/−3 μm, and the thickness of a conductive trace on any of the conductive layers 610, 620 and 630 is preferably within the tolerance of +/−2-3 μm. The thickness of the dielectric layers (e.g., 640, 650) is preferably within the tolerance of +/−2-3 μm. The distance between the first and second conductive layers is also preferably within the tolerance of +/−2-3 μm. The tolerance amount of the width, thickness and distance may be greater in another embodiment.

An RF signal combiner 600 can be built bottom-up using a sequential process. A dielectric film D0 can be placed on a frame. A conductive layer 630 can be sputter plated and etched away to form conductive traces on the conductive layer 630. A dielectric film D1 with an adhesive layer A1 can be placed and laminated onto the conductive layer 630. A conductive layer 610 can be sputter plated and etched away to form conductive traces on the conductive layer 610. A dielectric film D2 with an adhesive layer A2 can be placed and laminated onto the stack including the conductive layer 610, the dielectric layer 640, the conductive layer 630, and the support layer 660. A conductive layer 620 can be sputter plated and etched away to form conductive traces on the conductive layer 620.

It is desirable to use pre-fabricated dielectric films D0, D1 and D2 whose thicknesses are uniform and well-controlled. It is also desirable to minimize the thicknesses of the adhesive layers A1 and A2 whose thicknesses may not be as uniform as the pre-fabricated dielectric films. This can provide better reproducibility and better uniformity.

According to various aspects of the subject technology, an RF signal combiner (e.g., an RF signal combiner 300 or 400) can provide various benefits. For instance, the RF signal combiner can be utilized for a wide bandwidth (e.g., ≧one-octave bandwidth). Examples of a one-octave bandwidth or a wider bandwidth can be 10-20 GHz, 1-2 GHz, or 10-40 GHz, but the subject technology is not limited to these frequency ranges. Any frequency can be selected for reception or transmission within a wide bandwidth, without reconfiguring or tuning the device. For example, if an RF signal combiner has a bandwidth of 10-40 GHz, then any frequency (e.g., 10, . . . 15, . . . 20, . . . 25, 26, 27, . . . 30, 31, . . . 39, 40 GHz or a non-integer frequency) can be selected to receive or transmit signals without tuning the RF signal combiner. A conventional device needs to be tuned to select a specific frequency within a frequency range.

According to various aspects of the subject technology, an RF signal combiner (e.g., an RF signal combiner 300 or 400) can provide a constant amplitude and a matched phase, as described above. It can also provide matching impedance (e.g., +/−5-10%). It can also provide controlled coupling (e.g., ≦3+/−0.5 dB coupling between the traces or between certain ports, such as ports 41 and 44, over the wide bandwidth). Furthermore, an RF signal combiner can have a small footprint and can be produced at low cost without, for example, any ferrous material. According to one embodiment, an RF signal combiner is a passive device.

According to an aspect of the disclosure, an overlay coupler of an RF signal combiner is a fundamental building block in complex RF structures and modules, specifically, in areas such as broadband Butler matrix designs. As multiple couplers are cascaded together in a variety of ways to construct these more complex structures, the variation associated with a conventional coupler limits the useful bandwidth of a Butler matrix and/or similar RF structures and modules. By implementing an inverted overlay coupler design, one can drastically reduce the frequency dependant variations that are normally associated with a traditional coupler, thus enabling wider instantaneous bandwidth RF structures and modules to be created.

According to various aspects of the subject technology, an RF signal combiner (e.g., an RF signal combiner 300 or 400) can enable the design and construction of a broadband Butler matrix such as a Ka band Butler matrix used in a Ka band beam forming network. By using a Butler matrix, one can eliminate the need for costly active microwave monolithic integrated circuits (MMICs), typically used in traditional beam forming networks. The subject technology can be scaled to even higher frequencies.

It should be noted that the figures (e.g., dimensions and arrangements) describe certain aspects of the subject technology. The subject technology is, however, not limited to the arrangements, dimensions and properties described in this disclosure. Various components and blocks may be arranged differently (e.g., arranged in a different order, or partitioned in a different way) all without departing from the scope of the subject technology. The term "less than" may be substituted with a term "not greater than" or "less than or equal to" according to some aspects of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention. The term "connected," "connection," "connect," "couple," "coupled," "coupling," or the like can imply direct or indirect connection or coupling.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an "embodiment" does not imply that such embodiment is essential to the subject technology or that such embodiment applies to all configurations of the subject technology. A disclosure relating to an embodiment may apply to all embodiments, or one or more embodiments.

All structural and functional equivalents to the elements of the various aspects described throughout this disclosure that are known or later come to be known to those of ordinary' skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A radio frequency (RF) communication device, comprising:

an RF signal combiner comprising:

a first element comprising a first section for phase matching, a second section for conductive-layer inversion and signal coupling, and a third section for phase matching, the first section connected to the second section, the second section connected to the third section, each of the first section, the second section, and the third section including a conductive trace;

a second element comprising a fourth section for phase matching, a fifth section for conductive-layer inversion and signal coupling, and a sixth section for phase matching, the fourth section connected to the fifth section, the fifth section connected to the sixth section, each of the fourth section, the fifth section, and the sixth section including a conductive trace; and one or more dielectric layers, wherein the conductive trace of the second section is formed on a layer different from a layer on which the conductive trace of the first section is formed and different from a layer on which the conductive trace of the third section is formed, wherein the conductive trace of the fifth section is formed on a layer different from a layer on which the conductive trace of the fourth section is formed and different from a layer on which the conductive trace of the sixth section is formed wherein the layer on which the conductive trace of the second section is formed is different from the layer on which the conductive trace of the fifth section is formed, wherein the conductive trace of the second section is located in proximity to the conductive trace of the fifth section to allow signal coupling between the conductive trace of the second section and the conductive trace of the fifth section, and wherein the conductive trace of the second section is not in direct contact with the conductive trace of the fifth section.

2. The RF communication device according to claim 1, wherein the layer on which the conductive trace of the first section is formed is a first conductive layer, the layer on which the conductive trace of the second section is formed is a second conductive layer, the layer on which the conductive trace of the third section is formed is the first conductive layer, the layer on which the conductive trace of the fourth section is formed is the second conductive layer, the layer on which the conductive trace of the fifth section is formed is the first conductive layer, the layer on which the conductive trace of the sixth section is formed is the second conductive layer, and a first one of the one or more dielectric layers is formed between the first conductive layer and the second conductive layer.

3. The RF communication device according to claim 2 further comprising a ground trace, wherein the ground trace is formed on a third conductive layer, a second one of the one or more dielectric layers is formed between the first conductive layer and the third conductive layer, and the first conductive layer is disposed between the second conductive layer and the third conductive layer.

4. The RF communication device according to claim 1 further comprising:

a first conductive via, a second conductive via, a third conductive via, and a fourth conductive via, wherein the first conductive via connects the conductive trace of the first section to the conductive trace of the second section, the second conductive via connects the conductive trace of the second section to the conductive trace of the third section, the third conductive via connects the conductive trace of the fourth section to the conductive trace of the fifth section, and the fourth, conductive via connects the conductive trace of the fifth section to the conductive trace of the sixth section.

5. The RF communication device according to claim 1, wherein the conductive trace of the second section overlaps vertically the conductive trace of the fifth section, the conductive trace of the first section does not overlap vertically the conductive trace of the fourth section, the conductive trace of the third section does not overlap vertically the conductive trace of the sixth section, a lateral gap exists between the conductive trace of the first section and the conductive trace of the fourth section, and a lateral gap exists between the conductive trace of the third section and the conductive trace of the sixth section.

6. The RF communication device according to claim 1, wherein the width of the conductive trace of the second section is less than the width of the conductive trace of the first section, the width of the conductive trace of the fifth section is less than the width of the conductive trace of the fourth section, and the width of the conductive trace of the fifth section is less than the width of the conductive trace of the second section.

7. The RF communication device according to claim 1, wherein the length of the conductive trace of the second section is less than the combined length of the conductive trace of the first section and the conductive trace of the third section, and the length of the conductive trace of the fifth section is less than the combined length of the conductive trace of the fourth section and the conductive trace of the sixth section.

8. A radio frequency (RF) communication device, comprising:

an RF signal combiner comprising:

a first element comprising a first section for signal coupling and phase matching, a second section for conductive-layer inversion, and a third section for signal coupling and phase matching, the first section connected to the second section, the second section connected to the third section, each of the first section and the third section including a conductive trace;

a second element comprising a fourth section for signal coupling and phase matching, a fifth section for conductive-layer inversion, and a sixth section for signal coupling and phase matching, the fourth section connected to the fifth section, the fifth section connected to the sixth section, each of the fourth section and the sixth section including a conductive trace; and one or more dielectric layers, wherein the second section comprises multiple conductive traces on multiple conductive layers, a first one of the multiple conductive traces of the second section is connected to a second one of the multiple conductive traces of the second section, wherein the conductive trace of the first section is on a layer same as a first one of the multiple conductive layers of the second section, and the conductive trace of the third section is on a layer same as a second one of the multiple conductive layers of the second section, wherein the fifth section comprises multiple conductive traces on multiple conductive layers, a first one of the multiple conductive traces of the fifth section is connected to a second one of the multiple conductive traces of the fifth section, wherein the conductive trace of the fourth section is on a layer same as a first one of the multiple conductive layers of the fifth section, and the conductive trace of the sixth section is on a layer same as a second one of the multiple conductive layers of the fifth section, wherein the first section is located in proximity to the fourth section to allow signal coupling between the first and fourth sections, and the first section is not in direct contact with the fourth section, and wherein the third section is located in proximity to the sixth section to allow signal coupling between the third and sixth sections, and the third section is not in direct contact with the sixth section.

9. The RF communication device according to claim 8, wherein a first conductive layer is the second one of the multiple conductive layers of the second section and the first one of the multiple conductive layers of the fifth section, a second conductive layer is the first one of the multiple conductive layers of the second section and the second one of the multiple conductive layers of the fifth section, the conductive trace of the first section is on the second conductive layer, the first one of the multiple conductive traces of the second section is on the second conductive layer, the second one of the multiple conductive traces of the second section is on the first conductive layer, the conductive trace of the third section is on the first conductive layer, the conductive trace of the fourth section is on the first conductive layer, the first one of the multiple conductive traces of the fifth section is on the first conductive layer, the second one of the multiple conductive traces of the fifth section is on the second conductive layer, the conductive trace of the sixth section is on the second conductive layer, a first one of the one or more dielectric layers is formed between the first conductive layer and the second conductive layer.

10. The RF communication device according to claim 9 further comprising a ground trace, wherein the ground trace is formed on a third conductive layer, a second one of the one or more dielectric layers is formed between the first conductive layer and the third conductive layer, and the first conductive layer is disposed between the second conductive layer and the third conductive layer.

11. The RE communication device according to claim 8 further comprising:

a first conductive via and a second conductive via, wherein the first conductive via connects the first one of the multiple conductive traces of the second section to the second one of the multiple conductive traces of the second section, and the second conductive via connects the first one of the multiple conductive traces of the fifth section to the second one of the multiple conductive traces of the fifth section.

12. The RF communication device according to claim 8, wherein the first one of the multiple conductive traces of the second section overlaps vertically the second one of the multiple conductive traces of the second section, the first one of the multiple conductive traces of the fifth section overlaps vertically the second one of the multiple conductive traces of the fifth section, the conductive trace of the first section overlaps vertically the conductive trace of the fourth section, and the conductive trace of the third section overlaps vertically the conductive trace of the sixth section.

13. The RF communication device according to claim 8, wherein the width of the first one of the multiple conductive traces of the second section is the same as the length of second one of the multiple conductive traces of the second section, the length of the first one of the multiple conductive traces of the fifth section is the same as the width of the second one of the multiple conductive traces of the fifth section, the width of the first one of the multiple conductive traces of the second section is less than the width of the conductive trace of the first section, the width of the second one of the multiple conductive traces of the fifth section is less than the width of the conductive trace of the sixth section, the width of the conductive trace of the fourth section is less than the width of the conductive trace of the first section, and the width of the conductive trace of the third section is less than the width of the conductive trace of the sixth section.

14. The RF communication device according to claim 8, wherein the length of the first one of the multiple conductive traces of the second section is less than the combined length of the conductive trace of the first section and the conductive trace of the third section, and the length of the first one of the multiple conductive traces of the fifth section is less than the combined length of the conductive trace of the fourth section and the conductive trace of the sixth section.

15. The RF communication device according to claim 8, wherein each of the width and the length of the first one of the multiple conductive traces of the second section is less than the length of the conductive trace of the first section and is less than the length of the conductive trace of the third section, each of the width and the length of the second one of the multiple conductive traces of the second section is less than the length of the conductive trace of the first section and is less than the length of the conductive trace of the third section, each of the width and the length of the first one of the multiple conductive traces of the fifth section is less than the length of the conductive trace of the fourth section and is less than the length of the conductive trace of the sixth section, and each of the width and the length of the second one of the multiple conductive traces of the fifth section is less than the length of the conductive trace of the fourth section and is less than the length of the conductive trace of the sixth section.

16. The RF communication device according to claim 8 further comprising:

a plurality of RF signal combiners;

a plurality of phase shifters; and a plurality of RF crossovers.

17. A radio frequency (RF) communication device, comprising:

an RF signal combiner comprising a plurality of conductive layers and one or more dielectric layers, the RF signal combiner comprising a first port, a second port, a third port, and a fourth port, the RF signal combiner comprising phase-matching sections for phase-matching, signal coupling sections for signal coupling, and conductive-layer inversion sections for conductive-layer inversion, the RF signal combiner comprising a first element and a second element, wherein the first element comprises the first port, the third port, a first one of the phase-matching sections, a first one of the signal coupling sections, and a first one of the conductive-layer inversion sections, wherein the second element comprises the fourth port, the second port, a second one of the phase-matching sections, a second one of the signal coupling sections, and a second one of the conductive-layer inversion sections, wherein the first element comprises two conductive layers, and the first one of the conductive-layer inversion sections inverts a path of the first element from a first one of the two conductive layers to a second one of the two conductive layers of the first element, wherein the second element comprises the two conductive layers, and the second one of the conductive-layer inversion sections inverts a path of the second element from the second one of the two conductive layers to the first one of the two conductive layers, wherein the phase-matching sections are configured to match a phase difference between the first port and the third port with a phase difference between the fourth port and the second port, wherein the phase-matching sections are configured to match a phase difference between the first port and the fourth port with a phase difference between the third port and the second port, wherein the first element is not in direct contact with the second element, wherein the plurality of conductive layers comprises the two conductive layers and a third conductive layer, and wherein the third conductive layer is a ground layer disposed below the two conductive layers.

18. The RF communication device of claim 17, wherein the first element comprises the first port, a first section, a second section, a third section, and the third port, each of the first, second and third sections including a conductive trace, the second element comprises the fourth port, a fourth section, a fifth section, a sixth section, and the second port, each of the fourth, fifth and sixth sections including a conductive trace, the first one of the phase-matching sections comprises the first section and the third section, the first one of the signal coupling sections comprises the second section, the first one of the conductive-layer inversion sections comprises the second section, the second one of the phase-matching sections comprises the fourth section and the sixth section, the second one of the signal coupling sections comprises the fifth section, the second one of the conductive-layer inversion sections comprises the fifth section, the conductive trace of the first section is on the first one of the two conductive layers, the conductive trace of the second section is on the second one of the two conductive layers, and the conductive trace of the third section is on the first one of the two conductive layers, the conductive trace of the fourth section is on the second one of the two conductive layers, the conductive trace of the fifth section is on the first one of the two conductive layers, and the conductive trace of the sixth section is on the first one of the two conductive layers, the RF signal combiner comprises a first region, a second region, and a third region, the first and fourth sections are in the first region, the second and fifth sections are in the second region, and the third and sixth sections are in the third region, and the conductive trace of the second section and the conductive trace of the fifth section overlap.

19. The RF communication device of claim 17, wherein the first element comprises the first port, a first section, a second section, a third section, and the third port, each of the first and third sections including a conductive trace, the second element comprises the fourth port, a fourth section, a fifth section, a sixth section, and the second port, each of the fourth and sixth sections including a conductive trace, the first one of the phase-matching sections comprises the first section and the third section, the first one of the signal coupling sections comprises the first section and the third section, the first one of the conductive-layer inversion sections comprises the second section, the second one of the phase-matching sections comprises the fourth section and the sixth section, the second one of the signal coupling sections comprises the fourth section and the sixth section, the second one of the conductive-layer inversion sections comprises the fifth section, the second section comprises multiple conductive traces on the two conductive layers, the conductive trace of the first section is on the second one of the two conductive layers, and the conductive trace of the third section is on the first one of the two conductive layers, the fifth section comprises multiple conductive traces on the two conductive layers, the conductive trace of the fourth section is on the first one of the two conductive layers, and the conductive trace of the sixth section is on the second one of the two conductive layers, the first one of the multiple conductive traces of the second section overlaps vertically the second one of the multiple conductive traces of the second section, the first one of the multiple conductive traces of the fifth section overlaps vertically the second one of the multiple conductive traces of the fifth section, the conductive trace of the first section overlaps vertically the conductive trace of the fourth section, the conductive trace of the third section overlaps vertically the conductive trace of the sixth section, the first one of the multiple conductive traces of the second section is connected to the second one of the multiple conductive traces of the second section, and the first one of the multiple conductive traces of the fifth section is connected to the second one of the multiple conductive traces of the fifth section.

20. The RF communication device of claim 17, wherein the RF signal combiner is configured to match an amplitude difference between the first port and the third port with an amplitude difference between the first port and the fourth port, and wherein the RF signal combiner is configured to match an amplitude difference between the first port and the fourth port with an amplitude difference between the third port and the second port.

* * * * *